US005119308A

United States Patent [19]

Samoto

[11] Patent Number: 5,119,308

[45] Date of Patent: Jun. 2, 1992

[54] CONTROL SYSTEM FOR SPINNING MACHINE

[75] Inventor: Yoshihiko Samoto, Kusatsu, Japan

[73] Assignee: Murata Kikai Kabushiki Kaisha, Kyoto, Japan

[21] Appl. No.: 396,450

[22] Filed: Aug. 21, 1989

[30] Foreign Application Priority Data

Aug. 26, 1988 [JP] Japan ..... 63-210619
Feb. 17, 1989 [JP] Japan ..... 1-39087

[51] Int. Cl.[5] ..... G06F 15/46

[52] U.S. Cl. ..... 364/470; 57/264; 57/265; 73/160

[58] Field of Search ..... 364/470; 57/264, 265; 73/160

[56] References Cited

U.S. PATENT DOCUMENTS 3,731,069 5/1973 Goto et al. ..... 364/563 X
4,045,659 8/1977 Akagawa et al. ..... 364/470
4,051,722 10/1977 Feller ..... 364/470 X
4,430,720 2/1984 Aemmer ..... 364/470 X
4,656,360 4/1987 Maddox et al. ..... 356/430 X
4,887,155 12/1989 Massen ..... 364/470
4,924,406 5/1990 Bergamini et al. ..... 364/470

*Primary Examiner*—Jerry Smith
*Assistant Examiner*—Allen M. Lo
*Attorney, Agent, or Firm*—Spensley Horn Jubas & Lubitz

[57] ABSTRACT

A control system for a spinning machine wherein a nonsteady yarn irregularity is measured on the real time basis and results of the measurement is displayed in a concentrated manner or directly displayed on a package. A computing device for computing a standard deviation from a yarn irregularity signal is provided so that a uniformity of a yarn irregularity is evaluated in addition to a thickness and a length of the yarn irregularity.

6 Claims, 9 Drawing Sheets

CONTROL SYSTEM FOR SPINNING MACHINE

FIELD OF THE INVENTION

This invention relates to a control system for a spinning machine composed of a large number of spinning units for detecting a yarn irregularity in the spinning machine.

RELATED ART STATEMENT

As an example of control system for a spinning machine composed of a large number of spinning units, there is a system disclosed in the gazette of Japanese Patent Laid-Open No. 62-53430. In the system, a serious defect such as a slub is detected by a slub catcher which is provided for each of units of a spinning machine, and the defect is cut and removed immediately. Then, a signal indicative of a variation in thickness of a yarn (yarn irregularity) from such slub catcher is taken in and converted into a digital value, and then, it is either Fourier transformed or integrated for a fixed period. The Fourier transformed signal is spectrum analyzed so that it may be notified depending upon a frequency of a peak portion of the signal by which one of rollers of the spinning unit the yarn irregularity is caused. Meanwhile, the integrated signal detects a total amount of non-cyclical irregularities caused by abrasion of a surface of an apron belt or the like and provides a warning.

In the system of the gazette mentioned above, a yarn irregularity arising from a mechanical defect of the spinning unit is detected. However, in addition to such steady yarn irregularity, the difference in mechanical characteristics (peculiarities) for each spinning unit or the quality (yarn quality) of material supply (sliver) fluctuates non-steadily for each spinning unit or for each package. Such non-steady yarn irregularities cannot be evaluated by the system of the gazette mentioned above.

Thus, in order to find out a yarn quality for each spinning unit or for each package, it is a conventional practice to sample some of wound-up packages, apply yarns wound on the packages to an Uster irregularity testing device and another testing device such as a spectrograph installed at a different location to effect evaluation of yarn irregularities to infer such non-steady yarn irregularities as described above.

The method of sampling packages to detect non-steady yarn irregularities by means of a separate testing device described above requires labor for sampling by manual operation and takes much time for measurement. Further, it has a problem that practically it is almost impossible to perform such operations frequently one by one for a large number of spinning units or packages even if labor of a large number of operators and many testing devices are used.

OBJECT AND SUMMARY OF THE INVENTION

The present invention has been made in consideration of such problems as described above, and it is an object of the present invention to provide a control system for a spinning machine wherein a non-steady yarn irregularity can be measured on the real time basis and results of the measurement can be displayed in a concentrated manner or directly displayed on a package.

In order to attain the object, according to the present invention, a control system for a spinning machine comprises a yarn irregularity detecting device for successively detecting a yarn irregularity in each spinning unit of the spinning machine, an averaging means for averaging a yarn irregularity signal from each of the yarn irregularity detecting devices, an adding means for adding a difference between the average value and values of the yarn irregularity signals, an evaluating means for comparing the addition amount and an addition time for a yarn irregularity with predetermined criteria for evaluation to evaluate the same into a frequency of a division corresponding to the thickness and the length of the yarn irregularity, and an indicating means for indicating the evaluation information in a classification for each of the spinning units in a concentrated manner or/and directly on a package.

Then, preferably a computing means for computing a standard deviation from a yarn irregularity signal from the yarn irregularity detecting device is additionally provided so that a uniformity of a yarn irregularity may also be evaluated in addition to a thickness and a length of the yarn irregularity.

DETAILED DESCRIPTION OF PREFERRED EMBODIMENTS

In the following, an embodiment of the present invention will be described with reference to the drawings.

Figure 2:
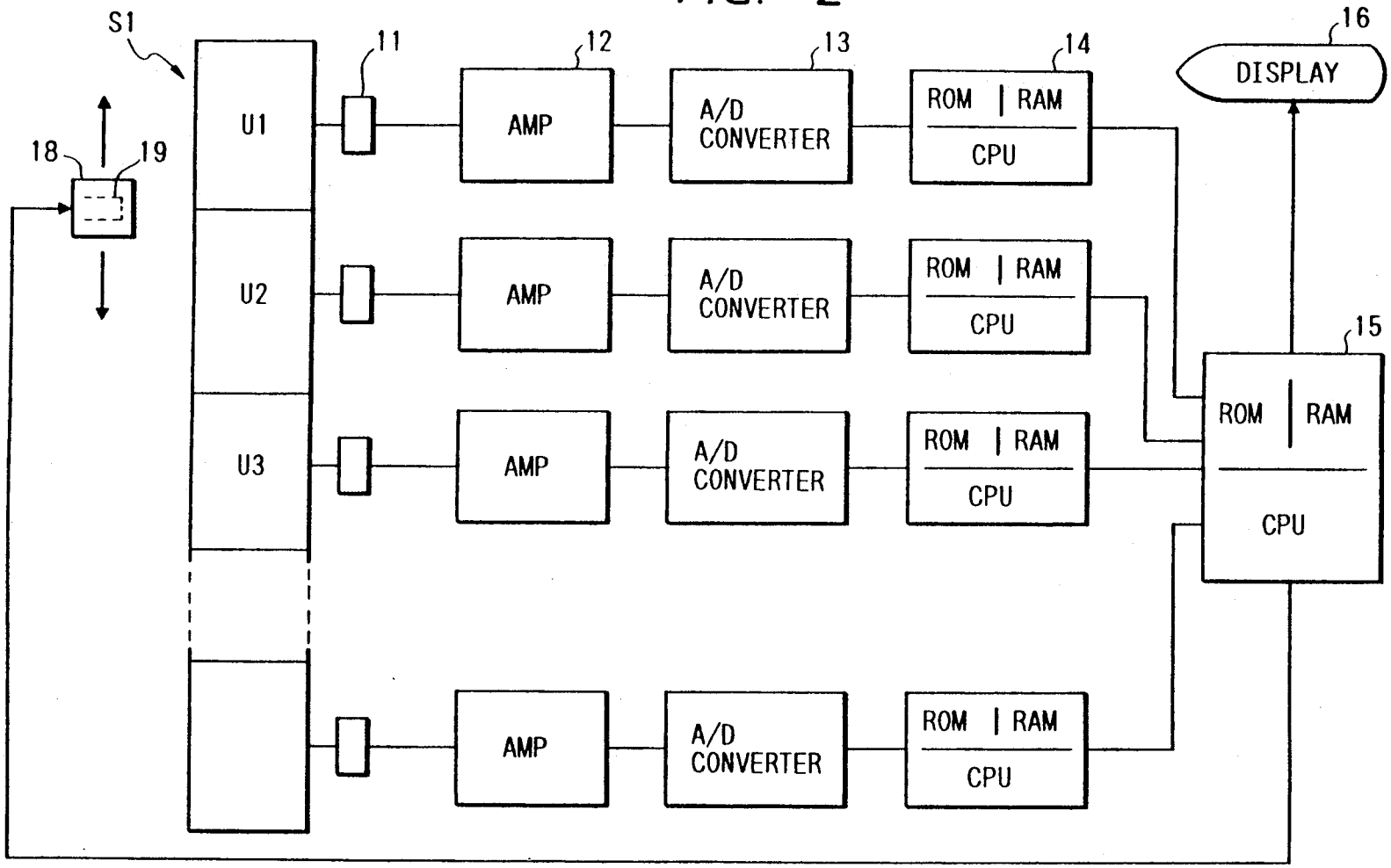
FIG. 2 a block diagram of an apparatus.

FIG. 2 is a block diagram of an entire control system. Referring to FIG. 2, a signal relating to a yarn from each of spinning units U1, U2, ... of a spinning machine S1 is detected by a yarn irregularity detector 11 such as a slub catcher and supplied to a local computer 14 by way of an amplifier 12 and an A/D converter 13. The local computer 14 is provided for each of the spinning units U1, U2, ... and evaluates an irregularity of a yarn being produced on the real time basis. A host computer 15 is provided for one or more of such spinning machines S1 and controls operation of the entire spinning machines and the quality. In particular, the host computer 15 stores therein data evaluated by the local computers 14 for each of the spinning units U1, U2 ... and supplies data to a display unit 16 which makes a display in a concentrated manner. Meanwhile, the host computer 15 operates an automatic doffing apparatus 18 so as to doff in response to a fully wound signal and prints, simultaneously with such doffing, a quality of each package at an end of a bobbin of the package by means of a printer such as an ink jetter 19.

Figure 3:
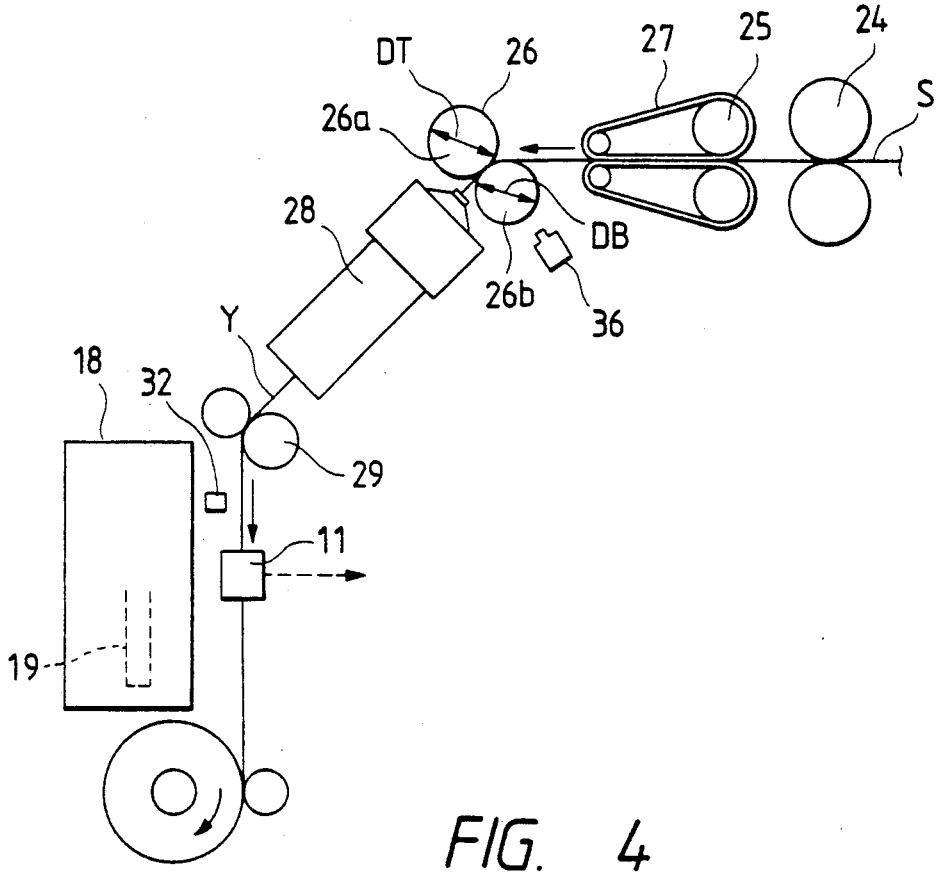
FIG. 3 a side elevational view of essential part of a spinning unit.

FIG. 3 shows essential part of each of the spinning units U1, U2, ... Reference numeral 24 denotes a back roller, 25 a middle roller, and 26 a front roller, and an apron 25 in the form of an endless rubber belt is wound around each of the middle rollers 25. Each of the rollers 24, 25 and 26 is composed of a top roller located above and a bottom roller located below and performs drafting of sliver S. Reference numeral 28 denotes an air jetting nozzle, which twists sliver S forwarded from the front rollers 26 to produce a spun yarn Y. Reference numeral 29 denotes a delivery roller for drawing out a yarn from the spinning nozzle 28, and 11 a photoelectric yarn irregularity detector or slub catcher for detecting a variation in thickness of the yarn Y to develop a yarn irregularity signal.

It is to be noted that reference numeral 18 in FIG. 3 denotes an automatic doffing apparatus, in which a printer such as an ink jetter 19 or a label applying device is installed so that, upon doffing of a package P, data relating to a quality for each package are printed at an end of a bobbin B. Meanwhile, a yarn velocity is detected by a sensor 36 provided proximate the lower front roller 26*b*. The yarn velocities are controlled by the host computer 15 for the entire spinning machine S1.

Figure 4:
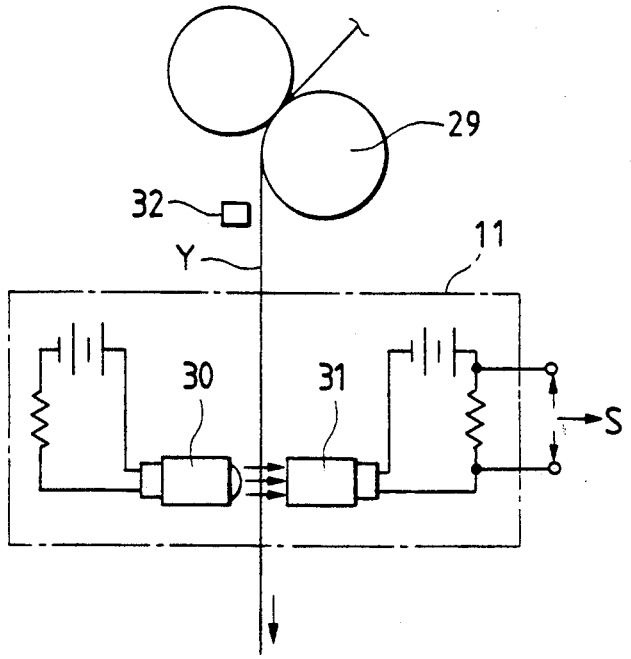
FIG. 4 a view showing a slub catcher.

As shown in detail in FIG. 4, the slub catcher 11 is a detector 11 of the type which is composed of a light emitting diode 30 and a photo-transistor 31 such that an amount of light sent out from the light emitting diode 30 is detected by the photo-transistor 31 and the amount of light thus detected is outputted as an electric displacement between terminals and which has a high sensitivity and a high responsiveness. If a slub passes through the slub catcher 11 so that the slub catcher 11 detects a very large displacement in quantity of electricity, a cutting device 32 operates in response to the signal from the slub catcher 11 to cut the yarn Y at the location. Such an electric signal from the slub catcher, that is, the yarn irregularity detector 11 as shown in FIG. 5*a* is utilized as a yarn irregularity analyzing signal.

Figure 5A:
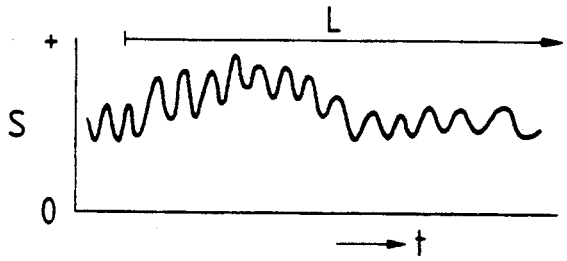
FIGS. 5*a*, 5*b* and 5*c* waveform charts.
Figure 5B:
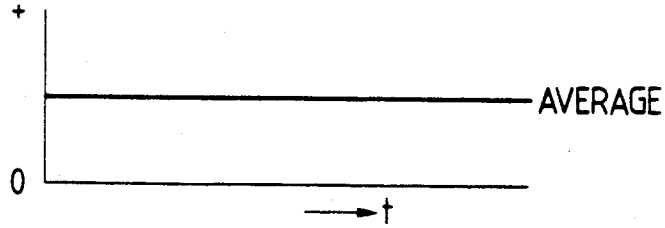
Figure 5C:
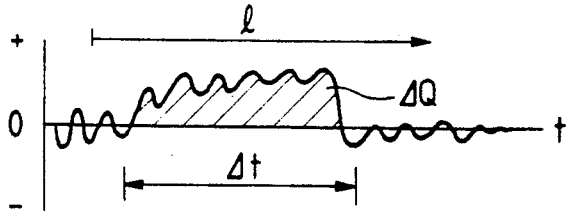

FIGS. 5*a*, 5*b* and 5*c* are views showing a processing of such yarn irregularity analyzing signal. While the raw yarn irregularity signal of FIG. 5*a* fluctuates at random, if this is moving averaged for a fixed section L, a moving average value is calculated as seen in FIG. 5*b*. If the moving average value of FIG. 5*b* is subtracted from the raw yarn irregularity signal of FIG. 5*a* and then added for another section l which is shorter than the moving average section, such $\Delta Q$ which corresponds to a magnitude of a yarn irregularity as shown in FIG. 5*c* is found out. Then, a period of time $\Delta t$ within which a mountain of $\Delta Q$ appears can be discriminated. The $\Delta Q$ is a signal corresponding to a thickness of the yarn irregularity while $\Delta t$ makes a signal corresponding to a length of the yarn irregularity (converted from the yarn velocity of the entire spinning machine U1).

Figure 6:
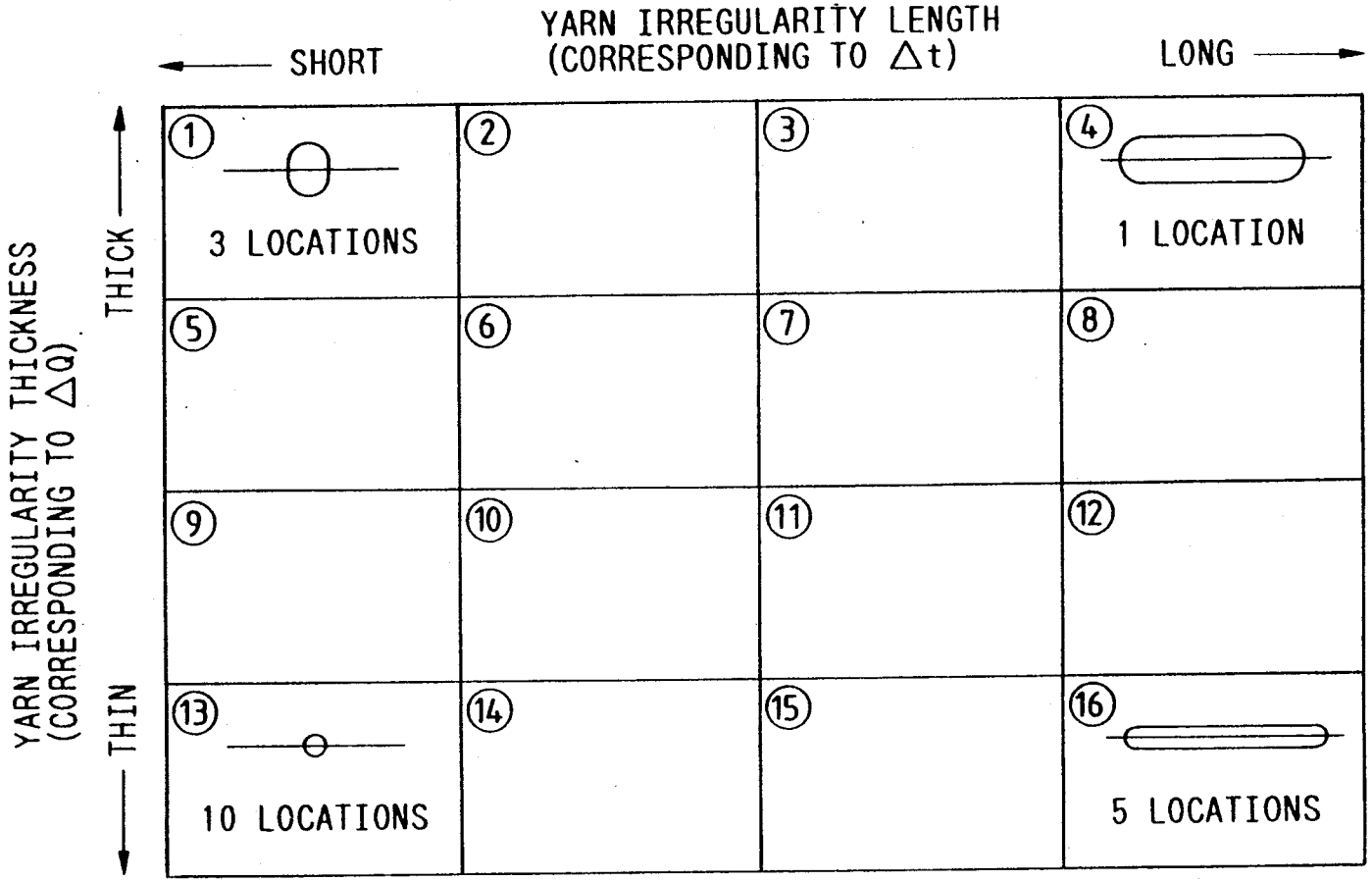
FIG. 6 a view illustrating a yarn irregularity classification.

Subsequently, an example of classification in evaluation will be described with reference to FIG. 6. FIG. 6 shows an example wherein lengths of yarn irregularities (corresponding to $\Delta Q$) are divided into 4 ranks ranging from a thickest one to a thinnest one and those are combined to classify yarn irregularities into 16 ranks from 1 to 16. A signal from a yarn irregularity detector 11 is processed so that it is evaluated to which one of the ranks of the table the yarn irregularity belongs depending upon $\Delta Q$ and $\Delta t$ from the yarn irregularity, and the yarn irregularity is recorded as one yarn irregularity so that entire yarn irregularities are arranged as a frequency. In FIG. 2, such a two dimensional table is displayed as it is by the display unit 16 such as, for example, a display device by way of the host computer 15. Further, it is also possible to mount, instead of the injector 19, a printer and a label applying device for applying an output thereof as a mark on the automating doffing apparatus 18 so that a two dimensional table may be applied so as to make a display.

Figure 1:
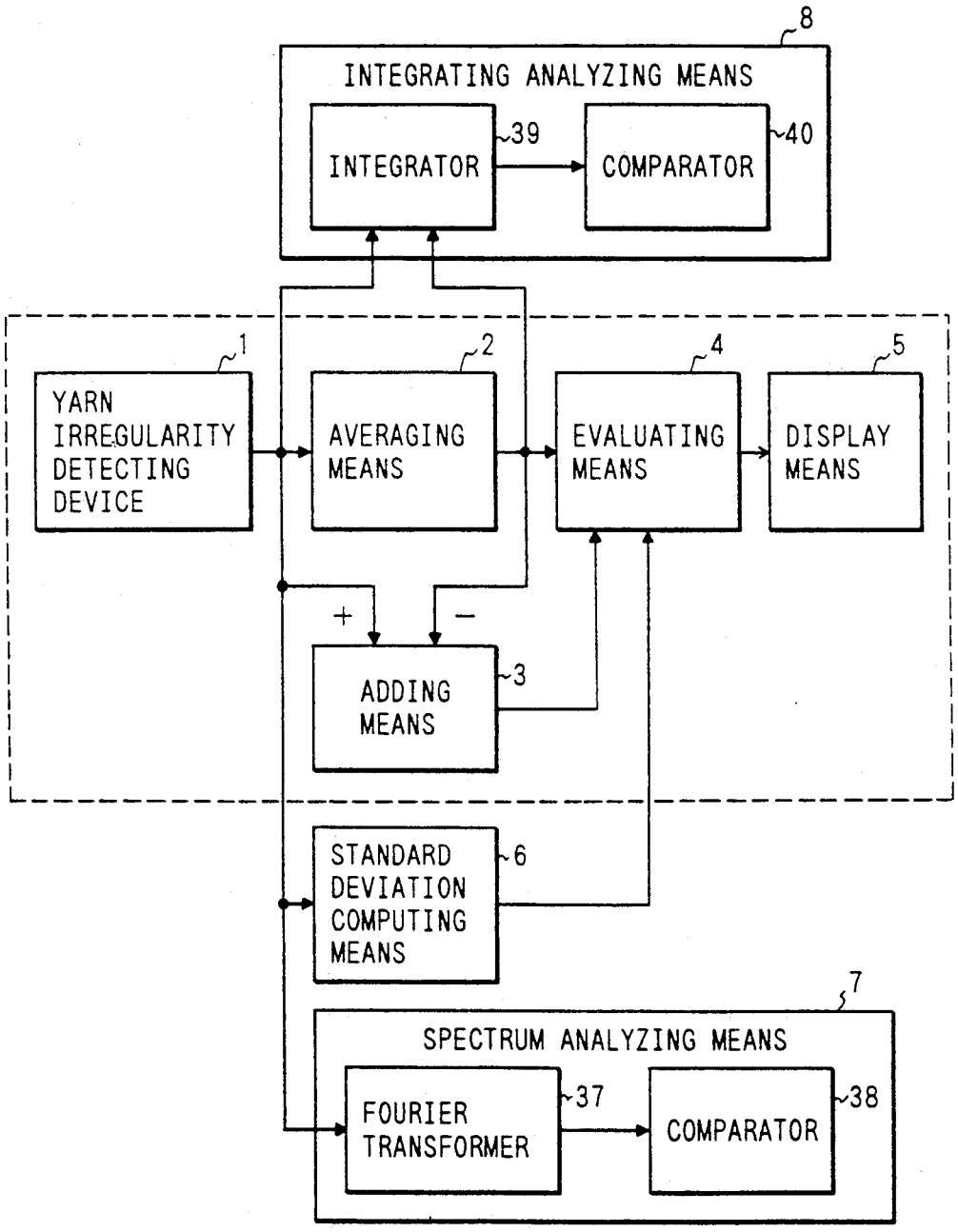
FIG. 1 is a block diagram showing construction of the present invention.

According to the present invention, a control system for a spinning machine comprises, as shown by a block of a long and short dash line in FIG. 1, a yarn irregularity detecting device 1 for successively detecting a yarn irregularity in each spinning unit of the spinning machine, an averaging means 2 for averaging a yarn irregularity signal from each of the yarn irregularity detecting devices, an adding means 3 for adding a difference between the average value and values of the yarn irregularity signals, an evaluating means 4 for comparing the addition amount and an addition time for a yarn irregularity with predetermined criteria for evaluation to evaluate the same into a frequency of a division corresponding to the thickness and the length of the yarn irregularity, and an indicating means 5 for indicating the evaluation information in a classification for each of the spinning units in a concentrated manner or/and directly on a package.

Then, preferably a computing means 6 for computing a standard deviation from a yarn irregularity signal from the yarn irregularity detecting device is additionally provided so that a uniformity of a yarn irregularity may also be evaluated in addition to a thickness and a length of the yarn irregularity.

Figure 7A:
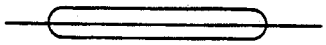
FIGS. 7*a* and 7*b* views illustrating uniformities of yarn irregularities.
Figure 7B:
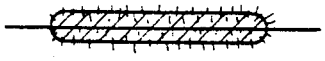

Then, FIGS. 7*a* and 7*b* are views showing uniformity of a yarn. Even if yarn irregularities having a same length and a same thickness are judged, there are such a yarn irregularity which presents a straight configuration as shown in FIG. 7*a*, such a different yarn irregularity which has fluff as shown in FIG. 7*b*, and a further irregularity which forms a doubles (a yarn having filaments floating on a surface thereof). In order to enable discrimination among them, a standard deviation computing means is added as shown in a constructive view of FIG. 1, and discrimination of fluff or a doubles is enabled by evaluating criteria for evaluation as three dimensional ones.

It is to be noted that, as shown in the constructive view of FIG. 1, a conventional spectrum analyzing means for detecting synchronous components of a yarn irregularity signal can be effected by a local computer 1. In particular, referring to FIG. 3, a pulse signal inputted from the detection sensor 36 for detecting rotation of the spinning machine front bottom roller 26*b* is inputted to the host computer 15, and a elocity of the yarn Y is calculated from a diameter DB of the roller 26*b*. Meanwhile, in case there is a scar or the like on peripheral surfaces of front rollers 26*a* and 26*b*, cyclic yarn irregularities are produced on the yarn Y being spun, and a peak will appear at frequency portions of an output of a Fourier transformer 37 of the local computer 14 corresponding to the rollers 26*a* and 26*b*. Those frequencies are determined from diameters DT and DB of the rollers and the yarn velocity mentioned hereinabove. Then, an output of the Fourier transformer 37 is supplied to a comparator 38 on which it is compared with an individually predetermined value, and the value of such comparison is transmitted to the host computer 15.

Meanwhile, it is also possible to integrate absolute values of amounts of displacement from a moving average value for a yarn irregularity signal in a fixed section by means of an integrator 39 to find out a total amount of yarn irregularities in a predetermined length and make a comparison by means of a comparator 40 to discriminate a non-cyclic fluctuation of a surface of an apron due to abrasion or the like by means of the local computer 14 and input it to the host computer 15.

Figure 8:
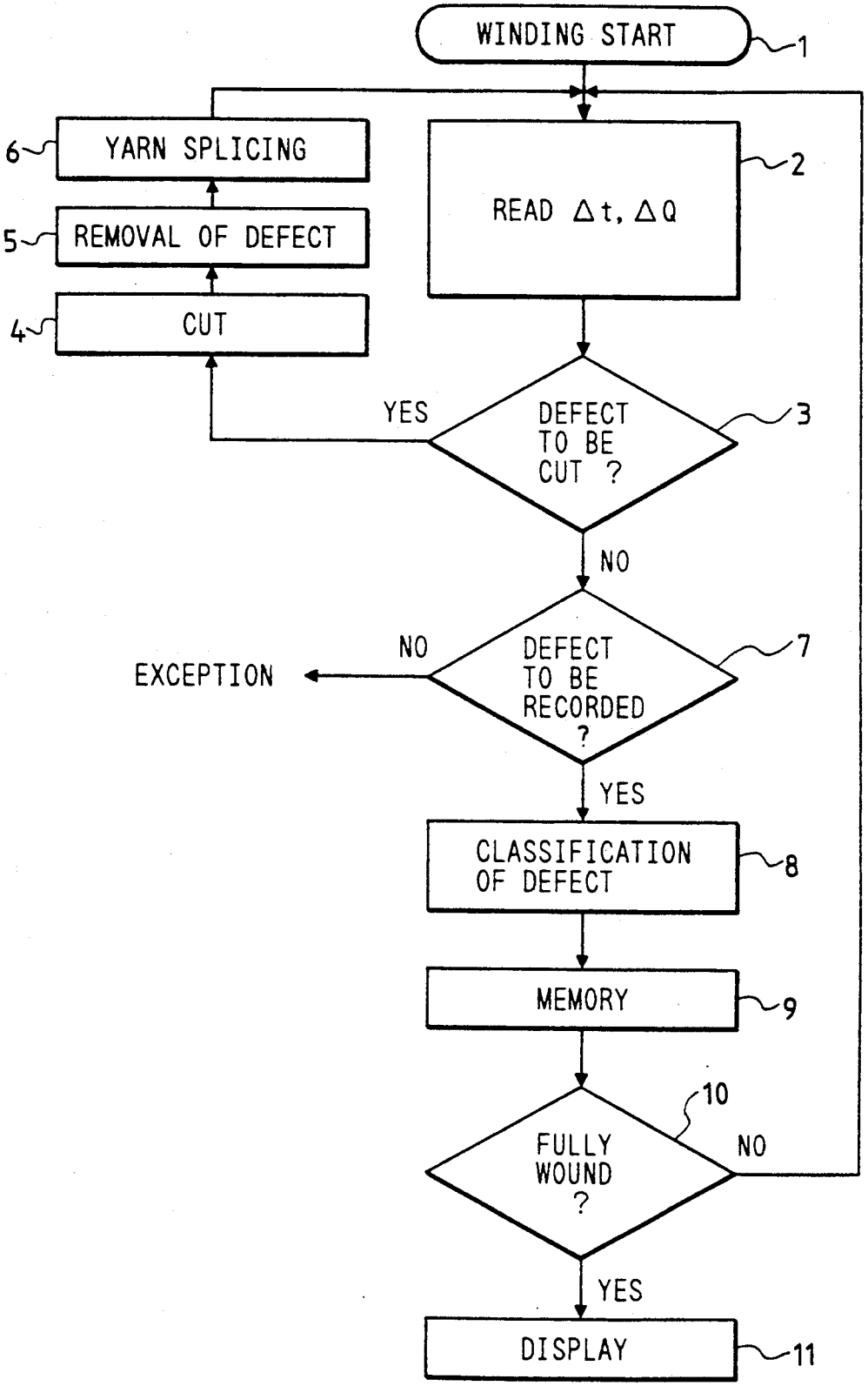
FIG. 8 a flow chart illustrating operation of a local computer.

Subsequently, operation of such local computers will be described with reference to a flow chart of FIG. 8. A local computer becomes aware of starting of winding depending upon a signal from the host computer (step ①). Then, reading in of Δt and ΔQ regarding an irregularity of a yarn being wound is executed (step ②). Then, it is judged whether or not the yarn irregularity is a defect to be cut (step ③). If the yarn irregularity is a defect to be cut, then the defect is removed, and then the yarn is spliced and winding is started again (steps ④ to ⑥). Even if the yarn irregularity is not a defect to be cut, it is judged from a magnitude of the defect whether or not the yarn irregularity should be recorded (step ⑦). A yarn irregularity which need not be recorded is excepted from data, but a yarn irregularity which should be recorded is classified depending upon degrees of the thickness, length and so forth to decide to which rank it should belong (step ⑧). Then, the thus classified defect is recorded into a memory. In short, memory areas are prepared by a number corresponding to the individual ranks from 1 to 16 of FIG. 6 in a RAM of the local computer 14, and in accordance with the rank classified at the step ⑧ described above, the count of a corresponding memory is incremented by one (step ⑨). Then, the steps from ② to ⑨ are repeated until a fully wound instruction is received from the host computer (step ⑩). Then, if a fully wound condition is reached, the data are transmitted to the host computer and a predetermined display is made (step ⑪).

It is to be noted that while in the description of the flow chart mentioned hereinabove not a defect to be cut but only a defect to be recorded is selectively recorded into the memory, the memory areas may be assured by a number greater than the number of the ranks from 1 to 16 such that all defects including defects to be cut may be classified into a greater number of ranks and a table including such classifications may be displayed. In this instance, it is also displayed that yarn irregularities outside a range of the displayed ranks are cut and removed while those within the range are included in the package.

Further, while in the foregoing description the memories corresponding to the ranks from 1 to 16 are provided in the local computer 14 for each of the units U1, U2, ..., such memory areas may be provided in the host computer 15 while the local computer 14 shares operation till the step of calculation of ΔQ and Δt shown in FIG. 5*c*.

As shown in FIG. 5, if a moving average value and a raw yarn irregularity signal value are added, then a volume ΔQ regarding one by one of yarn irregularities present in the moving average section is detected for a time of Δt. The ΔQ and Δt are compared with predetermined criteria for evaluation and classified in accordance with the thickness and the length thereof so as to evaluate yarn irregularities into a frequency of how many yarn irregularities are included in the section. Such evaluation is executed on the real time basis for each spinning unit, and if the evaluation is displayed directly on a package, then the quality can be recognized from the package, but if the evaluation is displayed for each spinning unit, the peculiarities of the spinning unit can be recognized from the spinning unit.

Then, the evaluation can be divided further finely by additional computation of a standard deviation and classification of a yarn uniformity.

Figure 9:
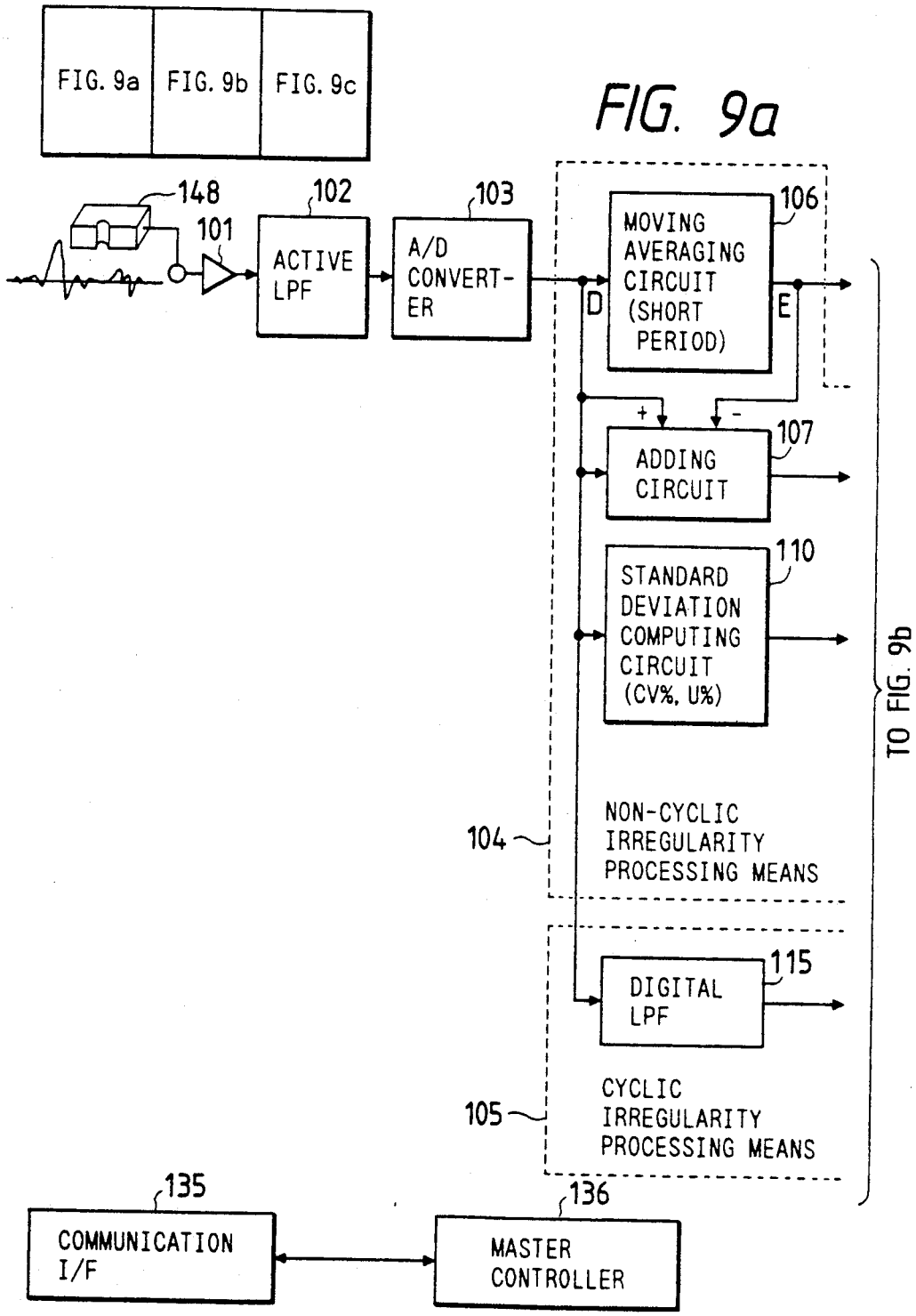
FIG. 9*a* through *c* is a block diagram showing an example of construction of a device provided for each spindle according to another embodiment.
Figure 9B:
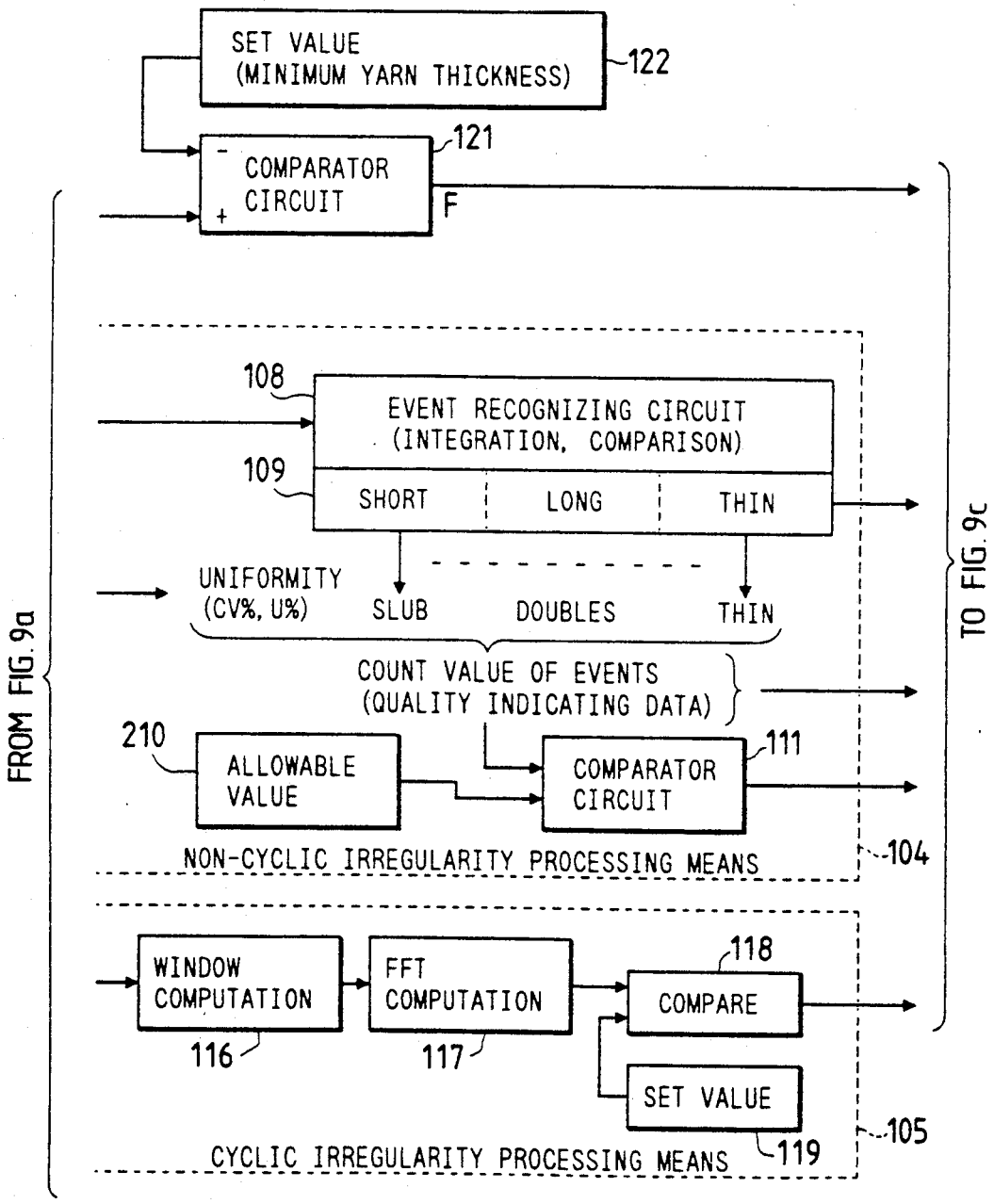
Figure 9C:
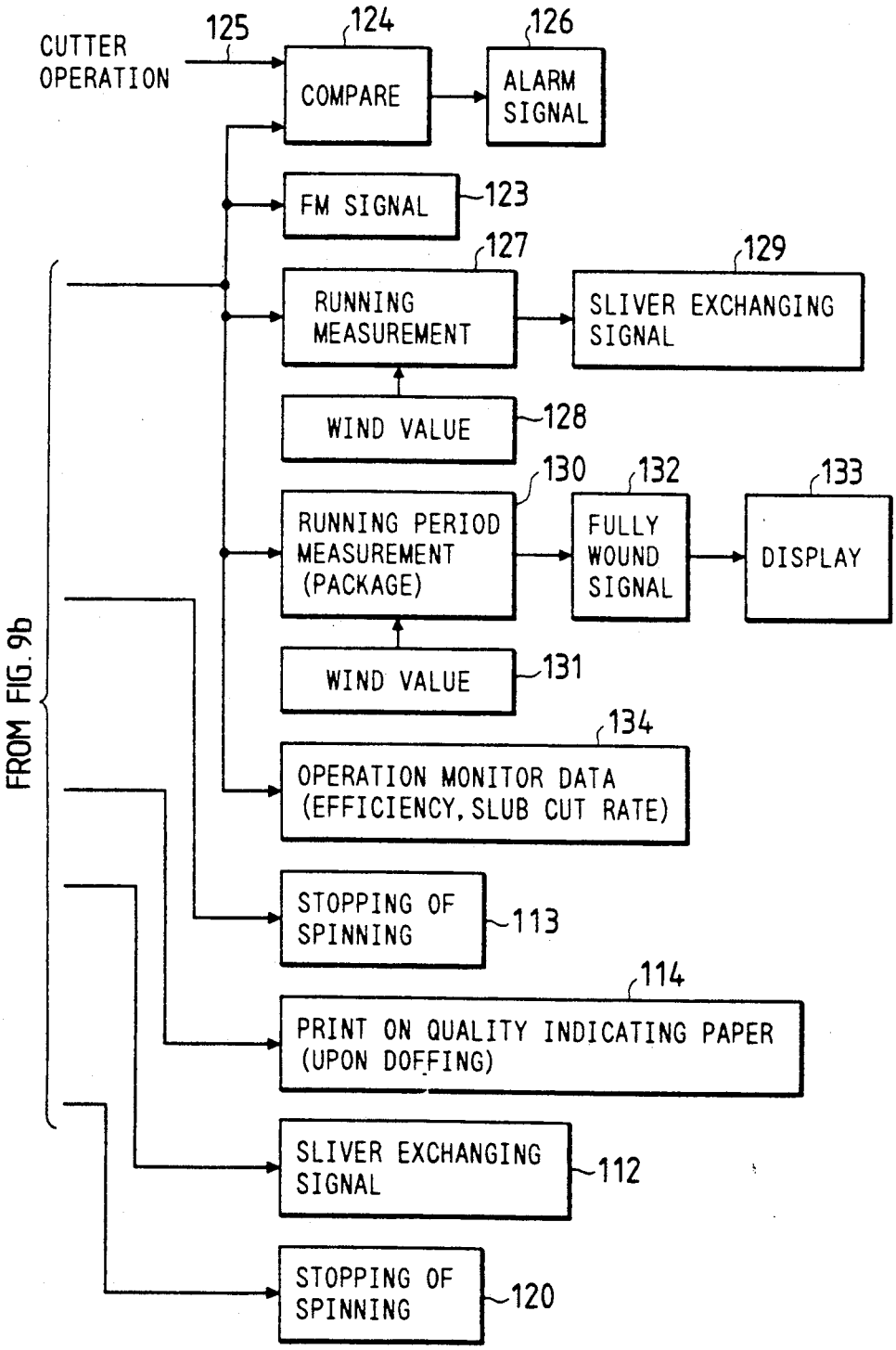

Meanwhile, FIG. 9 shows an entire circuit including a CPU integrated into a single chip as a device provided for each spindle in another embodiment, and the circuit makes an important element of the present yarn quality control system. Quality data obtained from the devices provided for the individual spindles are collected by a master controller 136 which successively communicates with the individual spindles and corresponds to the host computer 15 described hereinabove.

Referring to FIG. 9, an electric signal from a yarn irregularity detector 148 is amplified to a suitable voltage level by an amplifier 101 and passed through an active low pass filter (LPF) 102 at which substantially insignificant high frequency components are removed in advance therefrom. After then, the electric signal is sampled by an A/D converter 103 to convert the analog signal into a digital signal. The digital signal is inputted to and individually analyzed by a non-cyclic irregularity processing means 104 and a cyclic irregularity processing means 105.

(1) Non-Cyclic Irregularity Processing Means

At first, description will be given of the non-cyclic irregularity processing means 104. The non-cyclic irregularity processing means 104 is composed of a moving averaging circuit 106, an adding circuit 107, an event recognizing circuit 108, an event counter circuit 109, a standard deviation computing circuit 110, and a comparator 111.

The moving averaging circuit 106 is a circuit for calculating an average value (moving average) E of magnitude of a yarn irregularity signal over a fixed section (length of a yarn for an object of measurement) of a comparatively short period of time from a yarn irregularity signal D converted into a digital signal by the A/D converter 103, and the output E of the moving averaging circuit 106 represents an average thickness of the moving yarn. Accordingly, by comparing the output E of the moving averaging circuit 106 with a set value 122 of a minimum thickness of a yarn by means of a comparator 121, if the comparison output F of the comparator 121 is greater than 0, then it is determined that a yarn of a predetermined thickness is running.

The adding circuit 107 is a circuit which subtracts the moving average E from the yarn irregularity signal D converted into a digital signal by the A/D converter 103 to take out an amount of displacement of the yarn irregularity signal from the moving average E. From the adding circuit 107, a momentarily changing variation regarding a width, a length and a thinness of a yarn thickness is outputted in the form of a difference or a differentiation. The event recognizing circuit 108 integrates the variation of the yarn irregularity signal D from the moving average E for each fixed period of time, compares a result of the integration with preset values of various amounts regarding a width, a length and a thinness of a yarn thickness, and outputs results of such comparison individually to individually identify presence or absence of events indicated representatively by "short", "long", "thin" and so on. The event counter 109 individually counts appearances of events of "short", "long" and "thin" obtained from: the event recognizing circuit 108 each time an event appears. Due to the existence of the event recognizing circuit 108 and the event counter circuit 109, quality indicating data composed of a combination of two or more events such as "thin and short" or "thin and long" can be obtained, and in case a large defect such as a slub is detected, a spinning stopping instruction 113 is developed.

The standard deviation computing circuit 110 is a computing circuit which computes standard deviations of a coefficient of variation CV%, a coefficient of mean deviation U% and so forth based on the digital signal D from the A/D converter, and also uniformities (CV%, U% and so forth) of a yarn over a long section obtained from the standard deviation computing circuit 110 make part of such quality indicating data as described above. Individual count values for a fixed period of time regarding a width, a length and a thinness of a yarn thickness grasped by the event counter circuit 109 are compared with preset allowable values 210 of a yarn quality of the comparator circuit 111, and in case it is judged that appearances if individual events indicate that bad results as a yarn quality continue to the allowable limits, a sliver exchanging signal 112 is developed from the comparator circuit 111.

The quality indicating data obtained from the event counter circuit 109 and the standard deviation computing circuit 110 are transmitted to the printer 114 when required so that they are printed, upon doffing, together with a spindle number on predetermined quality indicating paper, which is then adhered to a doffed bobbin.

(2) Cyclic Irregularity Processing Means

The cyclic irregularity processing means 105 is composed of a digital flow pass filter (LPF) 115, a window computing circuit 116, an FFT computing circuit 117, and a comparator circuit 118.

A yarn irregularity signal D converted into a digital signal by the A/D converter 103 is changed to a signal of a frequency band for analysis by the digital low pass filter (LPF) 115 and then weighted by the window computing circuit 116 whereafter it is transmitted to and calculated by the Fourier transformer 117. A result of the calculation is vector composed into a power spectrum and outputted as a power spectrum of each frequency component. The output is transmitted to the comparator circuit 118 at which a peak level thereof in each region is compared with a preset level 119. In case the cyclic irregularities exceed a fixed limit, a stopping signal 120 for the spinning machine is developed.

In such a manner as described above, non-cyclic irregularities and cyclic irregularities are evaluated for the individual spindles and stopping of spinning of a spindle or exchanging of sliver is effected in accordance with results of such evaluations. Accordingly, each of the spindles need not wait until yarn irregularity evaluations of the other spindles come to an end, but can proceed a yarn irregularity evaluation of the spindle of itself independently.

(3) Operation Signal Processing

In addition to such evaluations of non-cyclic irregularities and cyclic irregularities as described above, production of information for operation and processing of signals therefor are executed on the device of FIG. 9.

An output E of the moving averaging circuit 106 of the non-cyclic irregularity processing means 104 is introduced into a comparator circuit 121 at which it is compared with a preset value 122 of a minimum yarn thickness, and if the yarn is normal, then a comparison output F is greater than zero, that is, makes a yarn presence signal. Since this is a condition wherein a yarn of a predetermined thickness is running, a yarn running (FW) signal 123 is outputted. If the comparison output F is equal to zero, then this means that a yarn is not running, that is, the yarn is broken. However, in order to allow a distinction from a break of the yarn arising from a cutter operation performed in response to normal detection of a slub, the comparison output F is introduced into a cut cause judging circuit 124, which generates an alarm signal 126 in a condition distinguished from a cutter operation signal 125.

In order to discriminate whether or not sliver as a raw material has been used up, the comparison output F is introduced into a running measuring circuit 127, by which a total running distance corresponding to a large number of bobbins is measured employing, for example, time as a unit. The measured distance is compared with a predetermined wind value 128. When the running distance reaches the predetermined wind value 128, it is judged that the raw material has been used up, and a sliver exchanging signal 129 is developed.

Further, in order to discriminate whether or not a bobbin has been put into a fully wound condition, the comparison output F is introduced into a running period measuring circuit 130, by which a running distance regarding a number of wound turns on a bobbin is measured employing, for example, time as a unit, and the measured distance is compared with a predetermined wind value 131. When the running distance reaches the predetermined wind value 131, it is determined that the bobbin has been put into a fully wound condition, and this is informed an operator by means of a display device 133.

Reference numeral 134 denotes a memory for collecting and storing therein data for monitoring operation of the spinning machines which are in operation at present, that is, data such as, for example, operation efficiencies or slub cutting rates. The operation monitoring data of the memory 134 are transferred to the master controller 136 by way of a communication interface 135 together with various data such as the quality indicating data of the non-cyclic irregularity processing means 104 or power spectra of individual frequency components of the cyclic irregularity processing means 105. Those data are taken into a CPU in the master controller 136 and displayed collectively. Accordingly, yarn qualities regarding the non-cyclic irregularity and the cyclic irregularity can be successively grasped in detail without taking time for each spindle, and a continuing or modifying instruction of operation at present can be provided from the master control side based on operation monitoring data.

While the foregoing description is given by way of an example mainly of a spinning machine in a spinning process, it is not limited to this. For example, there is rewinding as a finishing step of spinning. A winder is composed of a large number of spindles of winding units disposed in a laterally juxtaposed relationship, and a package is placed on each of traverse drums of each of the winding units. A bobbin after being spun is supplied to a predetermined location of each winding unit, and a yarn on the bobbin is drawn out upwardly in the direction of an axis of the bobbin and fed while being ballooned. The yarn then passes a tension device, a slub catcher and so forth and is rewound onto a package which is being rotated by the traverse drum. The present invention can be applied to yarn quality control for such a winder as described above.

According to the control system of the present invention, since a type and a number of yarn irregularities can be displayed on the real time basis for each spinning unit and/or each package, quality control for each spinning unit or for each package in a spinning machine can be made readily.

Then, if a display involves a uniformity by way of a standard deviation, then the quality control can be made more precisely.

What is claimed is:

1. A control system for a spinning machine having a plurality of spinning units, comprising:

yarn irregularity detection means for detecting non-cyclic yarn irregularities in each of the spinning units on a real time basis and for generating a corresponding yarn irregularity signal, averaging means in communication with the yarn irregularity means for calculating an average yarn irregularity and for generating a corresponding average value signal, addition means in communication with the averaging means for calculating the magnitude and duration of differences between the average value signal and the yarn irregularity signal for each spinning unit and for generating corresponding magnitude and duration signals, evaluation means in communication with the addition means for comparing the magnitude and duration signals with predetermined magnitude and duration information on a real time basis to thereby provide information regarding the thickness and the length of the yarn irregularities for each of the spinning units, and display means in communication with the evaluation means for displaying the information regarding the thickness and the length of the yarn irregularities for each of the spinning units determined by the evaluation means, whereby non-cyclic yarn irregularities are detected and evaluated on a real time basis for each of the plurality of spinning units.

2. A control system as in claim 1 wherein each spinning unit produces a yarn package and wherein the display means comprises means for displaying the information regarding the thickness and the length of the yarn irregularities on the yarn package.

3. A control system as in claim 1 wherein the evaluation means comprises classification means for classifying the thickness and the length of the yarn irregularities into one of a plurality of predetermined classes of thickness and length.

4. A control system as in claim 1, comprising:

computation means in communication with the yarn irregularity detection means and the evaluation means for computing a standard deviation of the yarn irregularity signal, whereby information regarding uniformity of the yarn irregularities for each of the spinning units is provided.

5. A control system for a spinning machine having a plurality of spindles, comprising:

yarn irregularity detection means for detecting non-cyclic yarn irregularities in each of the spinning units on a real time basis and for generating a corresponding yarn irregularity signal, conversion means in communication with the yarn irregularity detection means for digitizing the yarn irregularity signal, event recognition means in communication with the conversion means for integrating variations of the yarn irregularity signal from a moving average over a period of time and comparing the results of the integration with predetermined values, whereby the yarn irregularity signal over a given period of time is classified as corresponding to one of a plurality of predetermined events, counter means in communication with the event recognition means for counting the number of times an event occurs and for generating corresponding yarn quality data, yarn irregularity signal processing means for converting the digitized yarn irregularity signal from a time function into a frequency function to obtain quality data of cyclic yarn irregularities, and master controller means for collecting the quality data, whereby non-cyclic yarn irregularities are detected and evaluated on a real time basis for each of the plurality of spindles.

6. A control method for a spinning machine having a plurality of spinning units, comprising the steps of:

detecting non-cyclic yarn irregularities in each of the spinning units on a real time basis and generating a corresponding yarn irregularity signal, calculating an average yarn irregularity and generating an average yarn irregularity signal, calculating the magnitude and duration of differences between the average yarn irregularity signal and the yarn irregularity signal for each of the spinning units and generating corresponding magnitude and duration signals, comparing the magnitude and duration signals with predetermined magnitude and duration information on a real time basis to thereby provide information regarding the thickness and the length of the yarn irregularities for each of the spinning units, and displaying the information regarding the thickness and the length of the yarn irregularities for each of the spinning units, whereby non-cyclic yarn irregularities are detected and evaluated on a real time basis for each of the plurality of spinning units.

* * * * *